US011796282B1

(12) United States Patent
Ding et al.

(10) Patent No.: US 11,796,282 B1
(45) Date of Patent: Oct. 24, 2023

(54) FIREARM MOUNTING SYSTEM AND RELATED METHOD OF USE

(71) Applicant: Leapers, Inc., Livonia, MI (US)

(72) Inventors: Tai-lai Ding, Northville, MI (US); Cody M. Schulz, Harrison Township, MI (US)

(73) Assignee: Leapers, Inc., Livonia, MI (US)

( * ) Notice: Subject to any disclaimer, the term of this patent is extended or adjusted under 35 U.S.C. 154(b) by 0 days.

(21) Appl. No.: 18/134,176

(22) Filed: Apr. 13, 2023

Related U.S. Application Data

(62) Division of application No. 17/964,179, filed on Oct. 12, 2022, now Pat. No. 11,656,059.

(51) Int. Cl.
*F41C 23/16* (2006.01)
*F41C 27/00* (2006.01)
*F41G 11/00* (2006.01)

(52) U.S. Cl.
CPC ..... *F41C 23/16* (2013.01); *F41C 27/00* (2013.01); *F41G 11/003* (2013.01)

(58) Field of Classification Search
CPC ..... F41C 23/16; F41C 27/00; F41G 11/003
See application file for complete search history.

(56) References Cited

U.S. PATENT DOCUMENTS 5,343,650 A * 9/1994 Swan ..... F41C 23/16 42/117
5,522,166 A * 6/1996 Martel ..... F41G 11/003 42/127
6,508,158 B2 * 1/2003 Murello ..... F41A 3/72 89/1.42
RE39,465 E * 1/2007 Swan ..... F41C 23/16 42/75.01
7,231,861 B1 * 6/2007 Gauny ..... F41A 3/72 89/1.4
7,523,580 B1 * 4/2009 Tankersley ..... F41C 23/16 42/71.01
7,532,580 B2 4/2009 Tankersley
7,798,045 B1 * 9/2010 Fitzpatrick ..... F41A 21/481 89/1.4
8,141,285 B2 * 3/2012 Brown ..... F41A 3/12 42/71.01
8,156,854 B2 * 4/2012 Brown ..... F41A 3/72 89/1.4

(Continued)

*Primary Examiner* — Michelle Clement
(74) *Attorney, Agent, or Firm* — Warner Norcross + Judd LLP

(57) ABSTRACT

A firearm mount is provided including an upper handguard configured to extend above a cocking lever housing of a firearm and a receiver shroud extending rearward from the upper handguard and integrally formed with the upper handguard to form a single piece guard. The upper handguard can define a cocking lever slot and the receiver shroud can define an ejection port recess rearward of the slot. The receiver shroud can include a mounting rail, such as a picatinny rail, and opposing lateral sidewalls extending downward from the rail. The receiver shroud can simultaneously extend above a firearm receiver as the upper handguard extends above a cocking lever housing to cover an upper surface of the firearm. The guard can be secured to the firearm with opposing plugs having claws that engage ledges of the receiver to clamp the guard to the firearm. A related method of use is provided.

17 Claims, 7 Drawing Sheets

(56) References Cited

U.S. PATENT DOCUMENTS 8,307,747 B2 * 11/2012 Fitzpatrick ..... F41A 9/38 89/1.4
8,407,925 B2 * 4/2013 Fesas ..... F41A 3/66 42/75.01
8,438,770 B2 * 5/2013 Troy ..... F41C 23/16 42/71.01
8,539,871 B1 * 9/2013 Burt ..... F41A 9/38 89/1.4
8,561,517 B2 * 10/2013 Brown ..... F41A 3/72 89/1.4
8,607,490 B1 * 12/2013 Zinsner ..... F41C 23/16 42/71.01
8,640,372 B2 * 2/2014 Hochstrate ..... F41C 23/16 42/75.01
8,899,138 B2 * 12/2014 Brown ..... F41A 3/72 89/1.4
8,925,234 B1 * 1/2015 Barrett ..... F41A 3/22 42/75.01
8,997,620 B2 * 4/2015 Brown ..... F41A 7/00 89/1.4
9,109,848 B2 * 8/2015 Brown ..... F41A 7/02
D791,899 S * 7/2017 Fesas ..... D22/108
9,857,147 B2 * 1/2018 Drummond ..... F41G 11/003
9,958,223 B1 * 5/2018 McGinty ..... F41A 9/59
9,958,229 B1 * 5/2018 Meier ..... F41A 35/02
10,345,074 B1 * 7/2019 Zamlinskiy ..... F41C 23/10
10,352,635 B2 * 7/2019 Noonan ..... F41C 23/16
10,533,816 B2 * 1/2020 Schafer ..... F41A 3/72
10,578,396 B2 * 3/2020 Teetzel ..... F41G 11/003
10,591,247 B2 * 3/2020 Hubbell ..... F41G 11/003
10,627,177 B2 * 4/2020 Hamilton ..... F41A 9/59
10,670,364 B1 * 6/2020 Rients ..... F41A 3/66
10,677,551 B2 * 6/2020 Drake ..... F41A 3/66
D903,032 S * 11/2020 Swoboda ..... D21/573
10,895,430 B2 * 1/2021 Gomez ..... F41A 21/487
10,921,090 B2 * 2/2021 Schatz ..... F41C 23/16
10,962,324 B1 * 3/2021 Ding ..... F41G 11/004
11,073,350 B2 * 7/2021 Meier ..... F41A 3/66
11,085,714 B2 * 8/2021 Doll ..... F41G 11/003
11,105,571 B2 * 8/2021 Noonan ..... F41C 23/16
11,181,331 B2 * 11/2021 Schafer ..... F41A 15/12
11,187,474 B2 * 11/2021 Masters ..... F41A 3/66
11,473,863 B2 * 10/2022 Knöpfle ..... F41A 3/66
11,525,643 B2 * 12/2022 Karagias ..... F41A 3/72
11,525,644 B1 * 12/2022 Flick ..... F41A 3/66
2007/0169393 A1 * 7/2007 Frost ..... F41G 11/003 42/74
2012/0042554 A1 * 2/2012 Rich ..... F41A 35/02 42/16
2012/0318124 A1 * 12/2012 Brown ..... F41A 7/02 89/1.4
2013/0061737 A1 * 3/2013 Brown ..... F41A 3/72 89/1.4
2014/0060294 A1 * 3/2014 Brown ..... F41A 7/00 89/1.4
2014/0075814 A1 * 3/2014 Larson ..... F41A 3/26 89/193
2020/0182567 A1 * 6/2020 Barth ..... F41A 3/64
2021/0348862 A1 * 11/2021 Noonan ..... F41C 23/16
2021/0372722 A1 * 12/2021 Herring ..... F41A 9/37
2022/0146219 A1 * 5/2022 Noonan ..... F41A 5/30
2022/0196357 A1 * 6/2022 Wiedemann ..... F41C 23/20
2022/0381526 A1 * 12/2022 Perle ..... F41A 17/44

* cited by examiner

FIREARM MOUNTING SYSTEM AND RELATED METHOD OF USE

BACKGROUND OF THE INVENTION

The present invention relates to a weapon mounting system, and more particularly to a firearm mount for mounting accessories to a weapon such as a firearm.

Many modern sporting and military firearms include a handguard that extends forward of a receiver, and generally around a barrel of the firearm. The handguard prevents contact between the user and the barrel, thereby protecting the user when the barrel heats up after extended periods of fire. The handguard also can provide one or more rails or other surfaces upon which to mount accessories, such as lights, lasers, grenade launchers and other items.

An issue with many handguards is that they can be difficult to securely and precisely mount to a firearm. Frequently, handguards are provided with screws that tighten against a part of the barrel or some other portion of the firearm. While the screws can hold the handguard in most situations, they can sometimes give way and slide, so that the handguard can rotate, under excessive forces or moments exerted on the handguard, relative to the remainder of the firearm. In turn, this can provide an inadequate grasping surface. In other cases, where the rotation is significant, rails on the handguard can misalign with other rails on the remainder of the firearm. This can be particularly problematic where a sight or laser is mounted on the handguard. As a result of the rotation or misalignment, the firearm can become less accurate or an accessory can be damaged.

Yet further issues for handguards and accessory mounts can be present where the firearm is uniquely configured. For example, in an MP5 firearm, manufactured by Heckler & Koch of Germany, or variants thereof, a tube extends above the barrel, away from the receiver of the firearm. Due to its configuration, the tube has little or no good attachment points for accessories or other components. Thus, most handguards and rails for the MP5 are secured only to the receiver, or alternatively and separately under the tube. This reduces the amount of space for accessory mounting, as well as locations for a user to grip and handle the firearm.

Accordingly, there remains room for improvement in the field of mounting rails and handguards, and in particular, the way that they are secured to a firearm and their orientation relative to certain parts of the firearm.

SUMMARY OF THE INVENTION

An accessory mounting system for a weapon, such as a firearm, is provided including a handguard and a receiver shroud with a mounting rail.

In one embodiment, the handguard is configured to extend above a cocking lever housing and/or barrel of a weapon, such as a firearm, and a receiver shroud extending rearward from the upper handguard and integrally formed with the upper handguard to form a single piece guard.

In another embodiment, the receiver shroud can include a mounting rail, such as a picatinny rail, and opposing lateral sidewalls extending downward from the rail. The receiver shroud can simultaneously extend above a firearm receiver as the upper handguard extends above the cocking lever housing to cover an upper surface or upper portion of the firearm.

In still another embodiment, the upper handguard can define a cocking lever slot and/or the receiver shroud can define an ejection port recess rearward of the slot. The slot can be of an L configuration so that a cocking lever can move therein along at least two different paths to facilitate cocking of the firearm.

In yet another embodiment, the guard can be secured to the firearm with opposing plugs having claws that engage ledges of the receiver to clamp the guard to the firearm. The plugs can be inserted relative to plug holes defined by the receiver shroud from opposing sides of the receiver shroud.

In even another embodiment, the plugs can include a first plug disposed in a first plug hole defined by a first lateral sidewall of the shroud. The first plug can include a first claw configured to engage a first ledge of the receiver on a first side of the receiver. A first fastener can be operably coupled to the first plug and can extend within a first fastener hole transverse to the first plug hole defined by the first lateral sidewall.

In a further embodiment, the plugs can include a second plug disposed in a second plug hole defined by a second lateral sidewall of the shroud. The second plug can extend toward the first plug, in a direction opposite the first plug. The second plug can include a second claw configured to engage a second ledge of the receiver opposite the first ledge of the receiver. A second fastener can be operably coupled to the second plug and can extend within a second fastener hole transverse to the second plug hole defined by the second lateral sidewall.

In still a further embodiment, the first and second fasteners can be operable to engage the first and second claws with the first and second ledges respectively so that a portion of the receiver is clamped between an interior surface of the receiver shroud and the first and second claws in a clamp mode to secure the single piece guard to the firearm.

In yet a further embodiment, a method is provided. The method can include providing a firearm including a cocking lever housing joined with a receiver and an upper surface; providing a receiver shroud integrally formed with an upper handguard to form a single piece guard, the receiver shroud including an uppermost portion having a mounting rail, a receiver shroud interior surface opposite the mounting rail, a first lateral sidewall on a first side of a longitudinal axis of the single piece guard extending downward from the picatinny rail, and a second lateral sidewall on a second side of the longitudinal axis of the single piece guard extending downward from the mounting rail opposite the first lateral sidewall; placing the single piece guard over the upper surface so that the receiver shroud simultaneously extends above the receiver as the upper handguard extends above the cocking lever housing of the firearm, the receiver shroud interior surface being disposed adjacent the upper surface of the firearm; and securing the single piece guard to the firearm in a fixed orientation.

In even a further embodiment, the method can include sliding a first plug into a first plug hole defined by the first lateral sidewall toward the longitudinal axis of the single piece guard to engage a first ledge of the receiver; installing a first fastener relative to the first plug; sliding a second plug into a second plug hole defined by the second lateral sidewall toward the longitudinal axis of the single piece guard, in a direction opposite the first plug, to engage a second ledge of the receiver opposite the first ledge of the receiver; and installing a second fastener relative to the second plug.

In another embodiment, the method can include positioning a lower handguard below the cocking lever housing of the firearm; and extending a lower handguard fastener through a lower handguard fastener hole defined by the upper handguard to secure the lower handguard to the upper handguard. The method optionally can include placing a cocking lever of the firearm in a slot defined by the single piece guard.

The current embodiments provide a firearm mounting rail that mounts easily and rigidly to a variety of firearms, including but not limited to an MP5 firearm or variants thereof. Where the upper handguard and receiver shroud are integrally formed, a single piece guard can cover an upper surface of the firearm, and can provide a mounting rail there. Where the plugs are used, those can be inserted laterally, from the sides of the receiver shroud, so that claws of the plugs can engage respective ledges of the receiver on opposite sides of the receiver. Such plugs can be easy and quick to install, and can provide a consistent, rigid connection to the ledges and the receiver. When the plug fasteners are installed, they can exert associated vertical forces on the ledges and can clamp a portion of the receiver between the claws and an interior surface of the single piece guard to secure the guard to the firearm.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
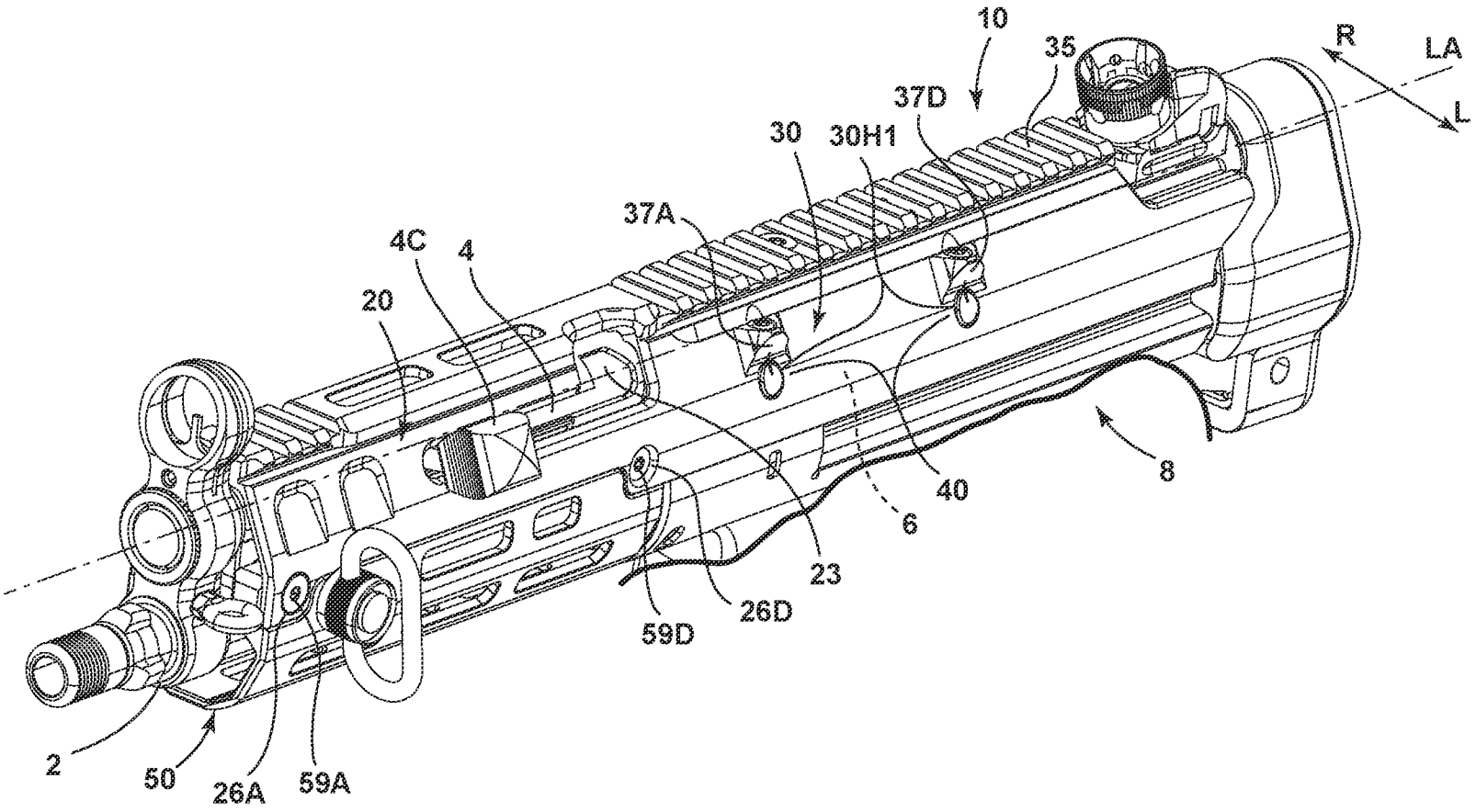
FIG. 1 is a first perspective view of the firearm mount of a current embodiment.

A current embodiment of the firearm mount is shown in FIGS. 1-7 and generally designated 10. The firearm mount 10 is configured to be secured over a barrel 2 and cocking lever housing 4 extending from a receiver 6 associated with a weapon 8, such as a firearm. The weapon 8 can be a sporting, military or hunting rifle or pistol, for example an MP5 from Heckler & Koch of Germany, variants thereof and other firearm or weapon systems that include a barrel, receiver and an optional cocking lever housing and/or gas tube. The mount 10 can include an upper handguard 20 that extends above the cocking lever housing 4 when mounted to the firearm 8. The mount 10 can include a receiver shroud 30 extending rearward from the upper handguard 20 and integrally formed with the upper handguard 20 to form a single piece guard having a longitudinal axis L. The receiver shroud 30 can be configured to extend above the receiver 6 of the firearm 8 simultaneously while the upper handguard 20 extends above the cocking lever housing 4 of the firearm 8 to cover an upper surface 9 of the firearm when the mount is installed relative to the firearm. The mount 10 can include a plug system 40 including plugs 41, 42, 43, 44 configured to be inserted into corresponding holes 30H1 and 30H2 on opposing sides of the mount 10 and in particular the receiver shroud 30. The plugs can be slid inward toward the longitudinal axis LA of the single piece guard ultimately to engage ledges or projections, commonly referred to herein as ledges 6A, 6B, 6C and 6D disposed on opposite sides of the receiver 6 and the longitudinal axis LA. Each individual plug can include a respective claw that directly engages the respective ledges on opposite sides of the receiver. When the plugs are actuated by respective fasteners, the respective claws can engage the respective ledges so that a portion of the receiver 6 is clamped in a clamp mode between a receiver shroud interior surface 301 and the claws to secure the single piece guard to the firearm 8 in a secure and rigid manner.

Turning now to FIGS. 1-7, the firearm mount 10 and components of the weapon 8 will now be described in further detail. As mentioned above, the mount 10 mounts over and above the cocking lever housing 4, as well as a barrel 2 of the firearm. The barrel 2 can include a muzzle end 2M and a receiver end 2R. The receiver end 2R can extend from the receiver 6. The cocking lever housing 4 can extend forwardly from the receiver 6. In some cases, that lever housing 4 can extend as a tube from a portion of the receiver 6 over the barrel 3. The components of the housing 4 and receiver 6 can be stamped from metal parts or otherwise formed or machined. The cocking lever housing 4 can house a cocking lever 4C that is designed to move a bolt within the receiver 4 to load a bullet in a chamber of the associated barrel 2. The cocking lever 4 can be configured to move linearly along a first path P1 that is generally parallel to the barrel axis BA and/or the longitudinal axis LA of the mount 10. The lever however also is movable along a second path P2 that is transverse to the first path P1. That second path P2 can be a curvilinear or arcuate path such that the cocking lever 4C rotates about the cocking lever housing axis HA, and further optionally within the mount 10 when mounted to the firearm 8.

With further reference to FIGS. 1-4, the mount 10 can include the upper handguard 20. The upper handguard 20 can extend forwardly, away from the receiver 6 above the cocking lever housing 4 as well as the barrel 2 and components thereof. Where the cocking lever housing 4 houses cocking lever 4C, the mount 10, and more particularly the upper handguard 20 can define a slot 23. The slot 23 can include different coextensive portions and can enable the cocking lever 4C to move at least two different directions along different paths. For example, the slot 23 can include a first portion 21 extending generally parallel to the longitudinal axis LA and along the first path P1, and optionally parallel to the housing axis HA. The slot 23 can include a second portion 22 that optionally is transverse the first portion 21. The second portion can extend generally perpendicular to the longitudinal axis LA and upward in a vertical manner, partially circumferentiating the housing axis HA. The second portion 22 of the slot 23 can extend along a second path P2 and in a second direction, different from the first direction along which the first path P1 extends. The second path P2 optionally can be perpendicular to the housing axis HA and can extend in a vertical direction. The first path P1 can extend along a horizontal orientation or direction, while the firearm is leveled with the barrel axis BA horizontally oriented.

Figure 2:
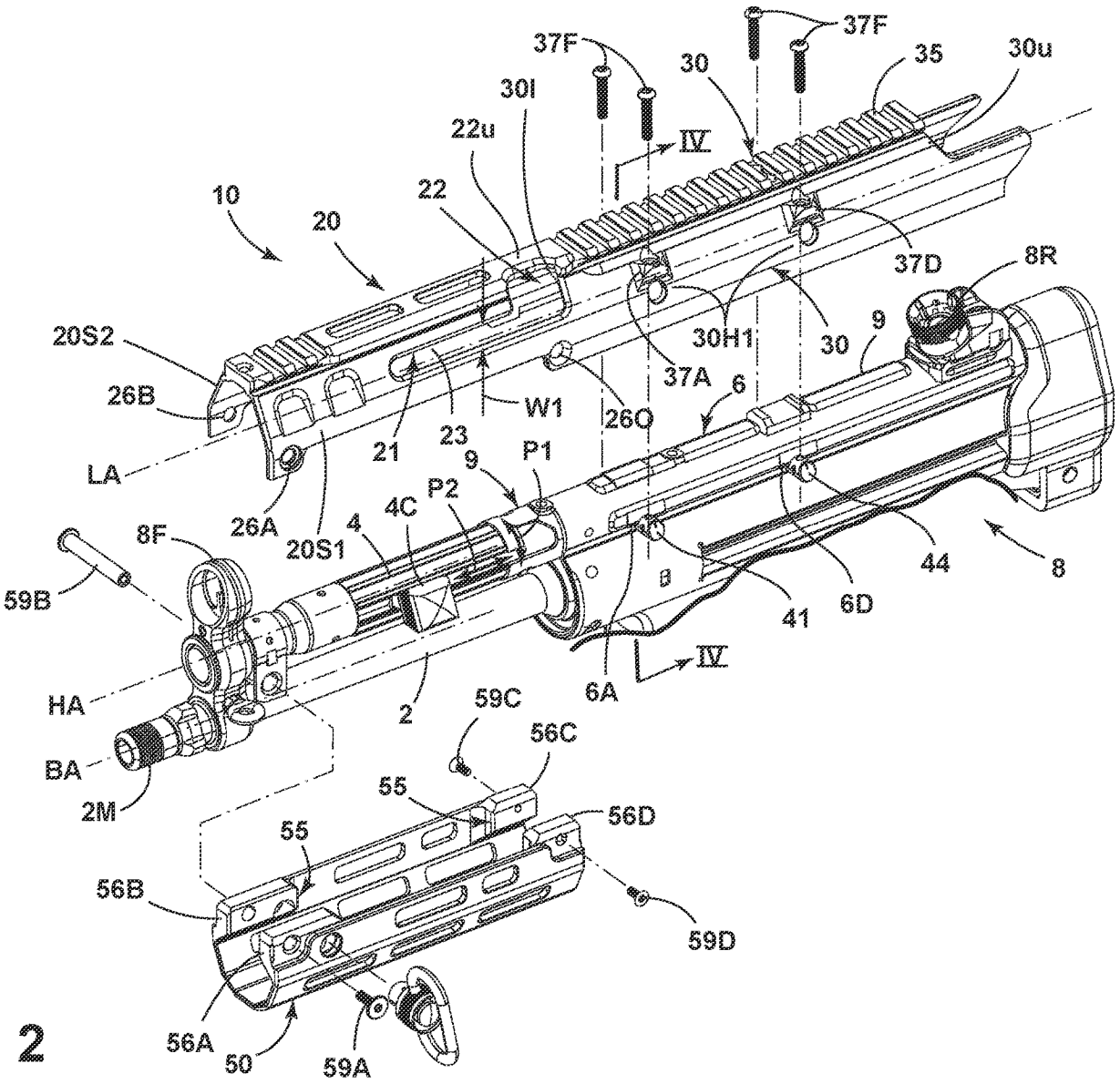
FIG. 2 is an exploded view of the firearm mount.

As shown in FIG. 2, the first and second portions 21 and 22 of the slot 23 can transition to one another at a corner 23C which can be radiused, rounded or curved to allow the cocking lever 4C to easily transition around that corner 23C. The second portion 22 of the slot can extend upward and can be formed in an upper wall 22U of the upper handguard 20. The first portion 21 of the slot 23 can be formed in a first sidewall 20S1 of the upper handguard 20, distal from the second sidewall 20S2 of the upper handguard 20. The respective sidewalls 20S1 and 20S2 can lay on opposite sides of longitudinal axis LA. Optionally, the first 21 and second 22 portions of the slot 23 can form an L-shape. Of course, depending on the firearm and movement path of the cocking lever, the shape of the slot 23 can vary.

Optionally, the firearm mount 10 can include a lower handguard 50 configured to extend below and/or under the cocking lever housing 4 and/or the barrel 2 of the firearm 8. The lower handguard 50 can extend forward from the receiver 6 and can at least partially surround and/or cover the barrel 2, between the ends 2R and 2M of the barrel 2. The lower handguard 50 can include one or more connectors 55 that can join the lower handguard 50 with the upper handguard 20 and/or a portion of the receiver 30. As shown, the connector 55 can include one or more blocks 56A, 56B, 56C and 56D. The blocks can align with lower handguard fastener holes 26A, 26B, 26C and 26D, shown for example in FIGS. 2 and 3 defined by the upper handguard 20. Respective lower handguard fasteners 59A, 59B, 59C and 59D of the connectors 55 can extend through the lower handguard fastener holes 26A, 26B, 26C and 26D and the blocks 56A, 56B, 56C and 56D to secure the lower handguard to the upper handguard and the remainder of the mount 10. In particular, the respective fastener 59B can be in the form of an elongated fastener with a threaded end. That fastener 59B can be installed relative to hole 26B and blocks 59B, 59A. Fastener 59A can be installed through hole 26A and into the threaded end of fastener 59B to secure the handguard there. Fasteners 59C and 59D can extend through respective holes 26C and 26D to engage the respective blocks 56C and 56D, which can be threaded. The fasteners can be sufficiently tightened to secure the lower handguard 50 to the upper handguard 20 and the associated receiver 30 of the single piece guard. Optionally, although the connectors are shown as associated with the lower handguard 50, they alternatively can be associated with the upper handguard 20, with the lower handguard including fastener holes through which fasteners can extend into the connectors. Further, the fasteners can come in various configurations and can engage the blocks and handguards in various manners.

Figure 3:
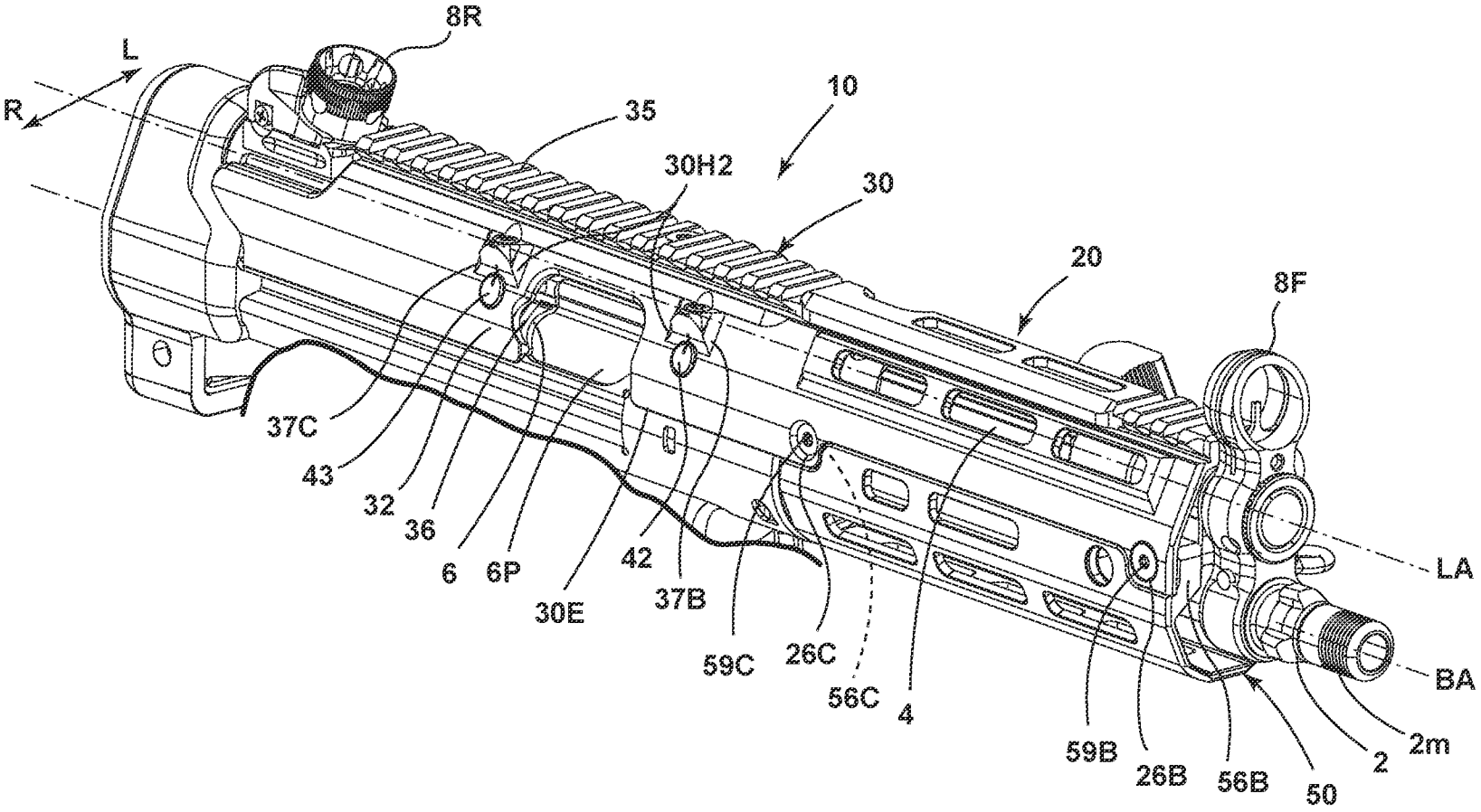
FIG. 3 is a second perspective view of the firearm mount.
Figure 4:
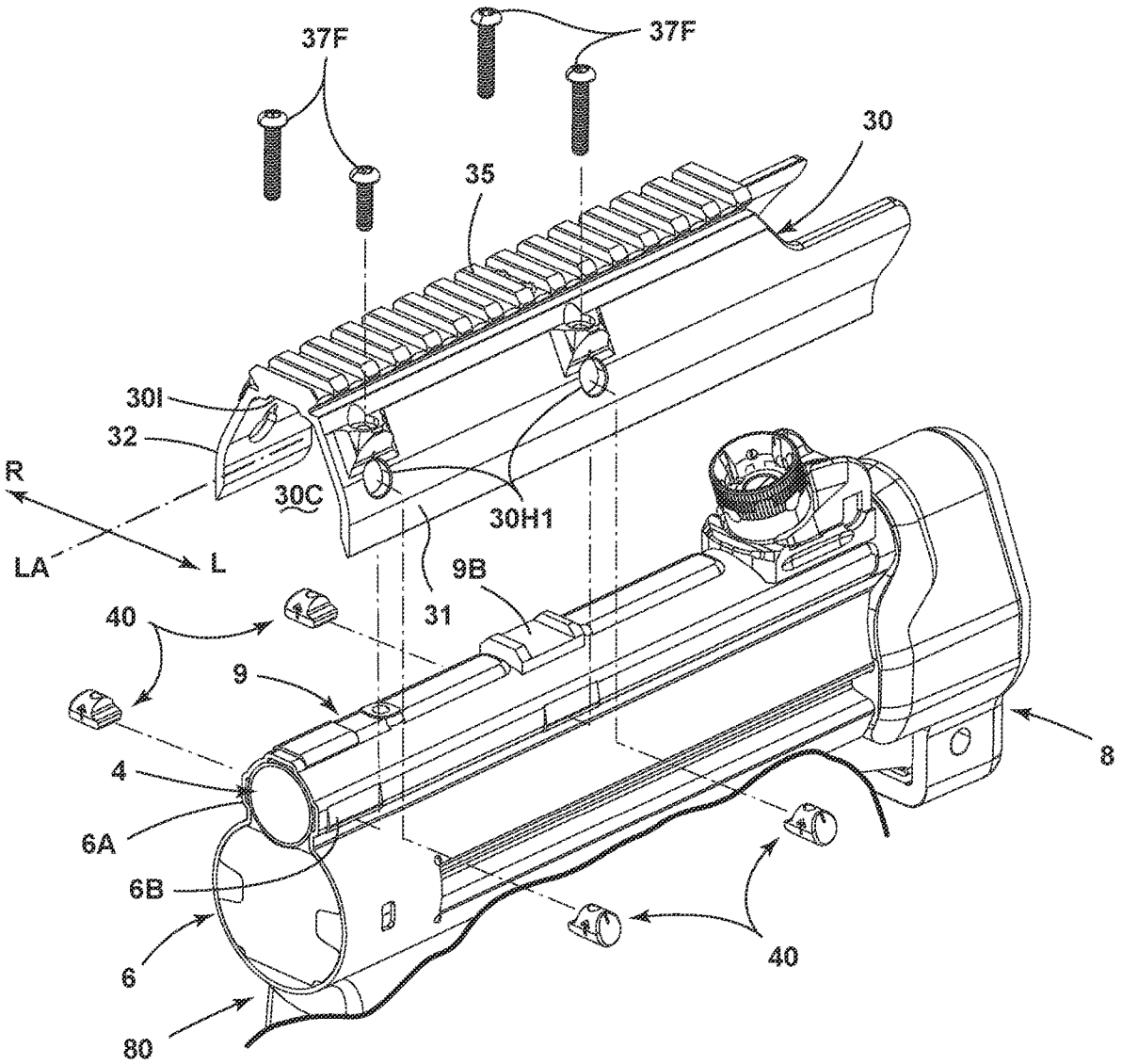
FIG. 4 is a close-up, section view of the firearm mount before assembly relative to a receiver of the firearm.

As shown in FIGS. 1-3, each of the upper handguard 20 and lower handguard 50 can be constructed in the form of a channel, such as a C-shaped or U-shaped channel, so that these respective components of the firearm mount 10 can extend at least partially around the barrel 2 and/or cocking lever housing 4. Each of the respective upper handguard and lower handguard can include exterior and interior surfaces. The exterior surfaces can be configured for grasping manually by a user and/or can include one or more accessory mounting rails, holes, recess, projections or the like. The handguards can be constructed to have a relatively slim and low-profile around the barrel 2 and/or the cocking lever housing 4, and can be contoured for easy manual grasping by a user. Optionally, a portion of the lower handguard 50 can include a swivel mount hole 57 that is disposed between the forward and rearward mounting blocks 56A and 56D. The swivel hole 57 can accommodate a variety of pins, posts etc. for associated swivels useful with the firearm 8. The handguards 20 and 50 also can include the above noted longitudinal axis or plane LA dividing the handguard and/or the mount 10 into left L and right R sides. These orientations, left L and right R are with reference to a user looking down the barrel 2 from the rear sight 8R to the front sight 8F. The various components of the firearm mount 10 can be constructed from metals, polymers, composites and/or combinations of the foregoing.

With reference to FIGS. 1-4, the receiver shroud 30 will be described in more detail. In particular, the receiver shroud 30 as mentioned above can be integrally formed with the upper handguard 20. In some cases, this can include a separately constructed shroud rigidly secured to the upper handguard with fasteners or other elements. However, as illustrated, the components form a single piece guard that is monolithic and that extends over both the receiver and the cocking lever housing. The receiver shroud 30 can include an uppermost portion 30U having a mounting rail 35, which as shown can be in the form of a picatinny rail, which is specified in MIL-STD 1913, which is hereby incorporated by reference in its entirety. Of course, other types of mounting rails such as Weaver rails, mounting blocks or other mounting structures can be used as a mounting rail as contemplated herein.

The receiver shroud 30 can include a receiver shroud interior surface 301 that is disposed opposite the mounting rail 35. This receiver shroud interior surface 301 can extend on the interior of the receiver shroud and can form a portion of the C- or U-shaped channel 30C that is defined by the receiver shroud 30 and or the handguard 20. The receiver shroud 30 can include a first lateral side wall 31 on a first side of the longitudinal axis LA, for example the left side L. This first lateral side wall 31 can extend downward, away from the mounting rail and/or upper interior surface 301 of the receiver shroud. The receiver shroud 30 can include a second lateral side wall 32 on a second side of longitudinal axis LA, for example, on the right side R of the longitudinal axis LA. The second lateral side wall 32 can extend downward from the mounting rail, opposite the first lateral side wall. Together, the first lateral side wall 31, receiver shroud interior surface 301 and second lateral side wall 32 can form a C- or U-shaped cavity compartment or channel 30C shown in FIG. 4.

Optionally, as shown in FIG. 3, the receiver shroud 30 can further define an ejection port recess 36 that aligns with an ejection port 6P of the receiver 6. The ejection port recess 36 can be disposed between adjacent plugs 40 on the second side, for example the right side R of longitudinal axis LA as shown. Of course, the ejection port recess 36 can be disposed on the other side L of the receiver shroud with weapons having a differently oriented ejection port. The ejection port recess 36 can extend upward from a lower edge 30E of the receiver shroud 30 such that the lower edge 30E is interrupted by that ejection port recess 36. In other constructions not shown, the edge 30E can be continuous and the ejection port recess 36 can be a true through hole that extends through the second lateral side wall 32 of the receiver 30, surrounded entirely by that wall 32. Further, although shown as extending only to about the same height as the plugs 40, the ejection port recess 36 optionally can extend upward to the mounting rail, and in some cases can be defined at least partially by the mounting rail 35, although not shown.

Figure 6:
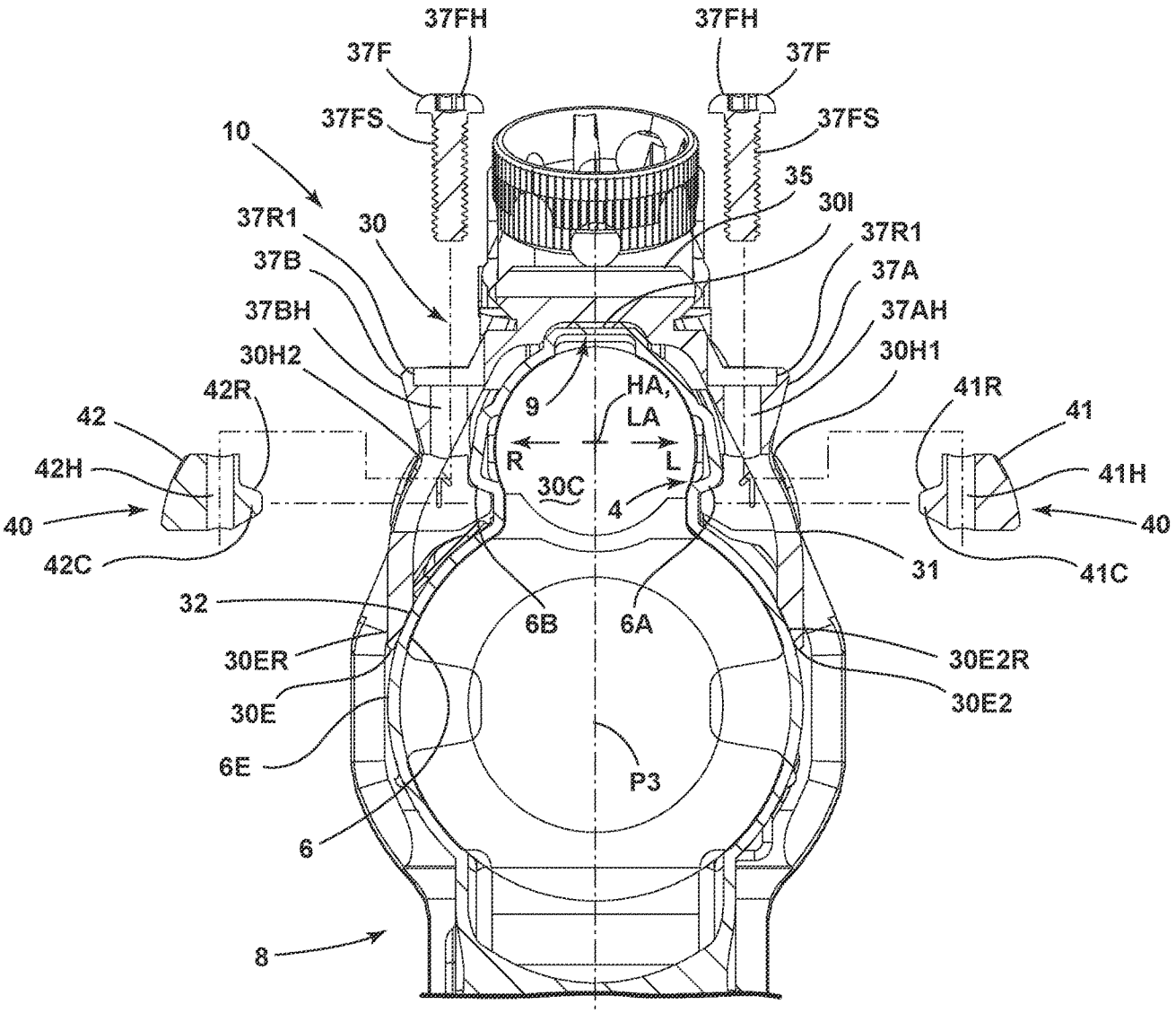
FIG. 6 is another section view of the firearm mount during assembly relative to the receiver.

With further reference to FIG. 6, as mentioned above, the receiver shroud 30 can include a lower portion that terminates at respective lower edges 30E and 30E2 of the respective sidewalls 32 and 31. These lower edges 30E and 30E2 can be configured to include ramped surfaces 30ER and 30E2R. These ramped surfaces can directly engage and/or can be placed adjacent the outer or exterior surface 6E of the receiver 6 when the guard unit is installed relative to the receiver 6. The ramped surfaces optionally can be slightly curved or angled and can rest immediately adjacent the curved or angled outer surface exterior surface 6E of the receiver 6 when the unit is fully installed.

As mentioned above, the mount 10 can include a plug system 40. This plug system 40 can include a first set of plugs disposed on a first side of longitudinal axis and a second set of plugs disposed on the opposite side of longitudinal axis LA. In some cases there may be only two plugs, one with each plug on each side of the longitudinal axis LA. As shown, however, there are a total of four plugs. Optionally, there may be additional and/or fewer plugs depending on the application and the firearm. The receiver shroud 30 can define the respective holes 30H1 and 30H2 on the respective first and second sides of longitudinal axis to receive the respective plugs 40 therein. Optionally, the holes 30H1 and 30H2 can be tubes and the respective plugs can be of a shape corresponding to the tubes. Further optionally, the holes can be cylindrical and the respective plugs can be cylindrical as well. This corresponding shape of the holes or tubes and plugs can allow sliding fitment of the plugs within the respective holes defined by the receiver shroud.

The receiver shroud 30 optionally can include one or more fastener shoulders or buttresses 37A, 37B, 37C and 37D above each of the respective fastener holes 30H1 and 30H2. As shown in FIG. 6, these buttresses can include shroud fastener holes, for example 37AH and 37BH that extend optionally vertically relative to the receiver shroud 30. These shroud fastener holes 37AH and 37BH can be configured to receive respective fasteners 37F. These shroud holes can be unthreaded as shown or threaded in some cases. The buttresses or shoulders can include respective recesses 37R1 that can receive the heads 37FH of the respective fasteners 37F. With these head recesses 37R1 defined in the buttresses, the heads 37FH can be below or flush with the tops of the buttresses so that they do not protrude. This provides a cleaner appearance and prevents snagging of those fasteners. Further, as shown in FIG. 6, the respective fastener holes 37AH and 37BH of the buttresses, for example, 37A and 37B, can be oriented substantially transverse to the longitudinal axis LA of the receiver shroud and/or the guard 10. Optionally, these holes and their respective axes can be perpendicular to the longitudinal axis LA as well as the housing axis HA of the cocking lever housing 4.

The plugs 40 as mentioned above can each include independent plugs 41, 42, 43 and 44. With reference to FIG. 6, the first and second plugs will be described in detail here, noting that all the plugs can be identical or very similar. Given this, the first plug 41 will be the primary focus here. As shown, the first plug 41 can include an exterior surface 41E configured to face outward and mate flush with the exterior surface 30E of the first lateral side wall 31. As shown, that surface can be contoured and optionally curved or angled. The first plug 41 can define a first fastener hole 41H that is transverse to the first plug hole 30H1 defined by the first lateral side wall 31. As an example, this plug hole 30H1, as well as the opposing second plug hole 30H2 can be oriented along a plug hole axis 30HA. The axis FA of the first fastener hole 41H can be transverse and/or perpendicular to the plug hole axis 30HA. The same can be true with the second fastener hole 42H of the second plug 42 as well as the other plugs used in connection with the mount 10.

Optionally, the first and second plug holes 30H1 and 30H2 on opposite sides of longitudinal axis LA can be aligned with one another. As shown, in FIG. 6, the holes can be aligned along the plug hole axis 30HA. This plug hole axis 30HA can be substantially perpendicular to the longitudinal axis LA and/or a vertical plane P3 that is coincident with that longitudinal axis LA. Further optionally, the plug hole axis 30HA can be horizontal when the firearm is in a level firing orientation, for example when the bore barrel axis BA and/or the longitudinal axis is substantially horizontal. In this level firing orientation, the first and second fastener holes 41H and 42H can be vertical. Further, the first fastener hole 41H and second fastener hole 42H can each be threaded to receive the threaded shafts 37FS of the respective fasteners 37F when installed as described below.

Figure 7:
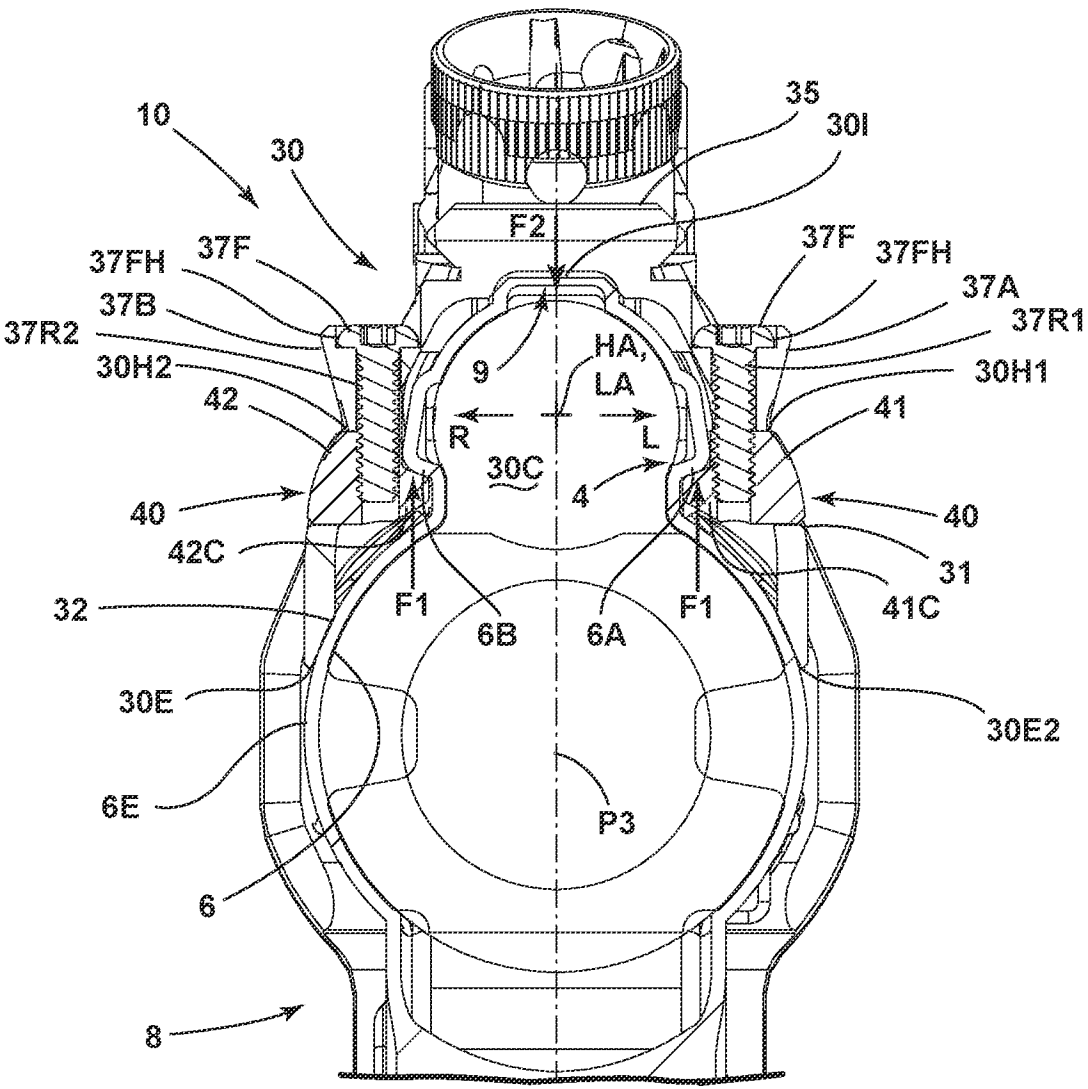
FIG. 7 is a section view of the firearm mount after assembly relative to the receiver.

With reference to FIGS. 6 and 7, the first plug 41 can include a first claw 41C that extends inwardly beyond the first fastener hole 41H. This first claw 41C can include a ramped surface 41R that is configured to engage a first ledge 6A of the receiver 6. The receiver 6 can include that first ledge 6A on a first side of the longitudinal axis LA and a second opposing ledge 6B on a second opposing side of the longitudinal axis LA. These ledges can be formed along the bottom or some other part of projections, slots, recess, bumps or other features on the receiver, optionally stamped or otherwise formed in the receiver. There can be one, two or more ledges on each of the respective sides of the longitudinal axis of the receiver and/or the mount 10. It will be appreciated that respective additional ledges can interface with the third 43 and fourth 44 plugs further rearward on the receiver in a similar manner as described here. Optionally, the second plug 42 likewise can include a second claw 42C, including a ramped surface 42, are similar to that of the first plug 41. Any additional optional third and fourth plugs 43 and 44 likewise can include such claws that can engage respective ledges of the receiver.

FIG. 6 shows the plugs 40, and in particular the first plug 41 and second plug 42, before installation in the respective plug holes 30H1 and 30H2, before the fasters 37F are installed in the respective holes 37AH and 37BH of the respective shoulders or buttresses 37A and 37B. FIG. 7, however, shows the plugs 40, and in particular the plugs 41 and 42, after installation of the plugs relative to the plug holes 30H1 and 30H2. As shown there, the plug 41 is installed in the first lateral side wall 31 and projects inwardly toward the longitudinal axis LA or vertical plane P3 with which the longitudinal axis LA is coincident. The plug 41 is inserted in the hole 30H1 with the claw 41C disposed adjacent and/or in direct contact with the ledge 6A. The fastener 37F is installed relative to the receiver shroud and is disposed in the buttress or shoulder 37A. The head 37FH of the fastener 37 is disposed in the recess 37R1 and placed flush with the top of the buttress 37A for a clean appearance. The shaft of the fastener 37FS is threaded so that it engages the threaded hole in particular the first fastener hole 41H defined by the first plug 41. The hole in the buttress 37AH however may not be threaded so that the threads of the shaft not engage that particular hole or the buttress. When the fastener 37F in FIG. 7 is rotated, for example in direction R about the fastener axis FA, the threads of the fastener engage the threads of the hole 41H of the first plug 41. As a result, the claw 41C is urged upward. When this occurs, it can exert a force F1 on the first ledge 6A. The other fastener installed similarly in the second plug 42 can operate in a substantially identical manner. When that other fastener is tightened, the second plug 42 also moves upward so the claw 42C exerts a force F1 against the second ledge 6B. As the fasteners are tightened, the forces F1 exerted on the ledges can result in a corresponding force F2 being exerted by the receiver shroud interior surface 301 against the upper portion or upper surface 9, or some other part, of the receiver 6. These forces F1 and F2 can cooperatively clamp a portion of the receiver 6 between the receiver shroud interior surface 301 and the first and second claws 41C and 42C (as well as any other claws of any other plugs 43, 44) in a clamp mode. In turn, this clamping action and the corresponding forces secure the mount 10 to the receiver 6 and to the firearm 8 in general. Optionally, the respective fasteners 37F can be tightened in a particular sequence so as to apply even and balanced forces against the ledges and the upper surface of the receiver. The mounting rail 35 also can be checked for its level relative to the upper surface or upper portion 9 of the receiver and other components of the firearm 8 so that when accessories are mounted thereto, they are generally level relative to those components.

A method of using the firearm mount 10 of the current embodiment will now be described with reference to FIGS. 2-7. The method can begin with providing the firearm 8, which can include a cocking lever housing 4 joined with a receiver 6 and an upper surface 9. The receiver shroud 30, integrally formed with an upper handguard 20 to form a single piece guard, can be provided. The single piece guard can be placed over the upper surface 9 so that the receiver shroud 30 simultaneously extends above the receiver 6 as the upper handguard 20 extends above and/or covers the cocking lever housing 6. The receiver shroud interior surface 301 can be disposed adjacent, for example, near and/or in direct engagement and contact with, the upper surface or other portion 9 of the firearm 8. The single piece guard can be secured to the firearm in a fixed configuration and/or orientation.

Figure 5:
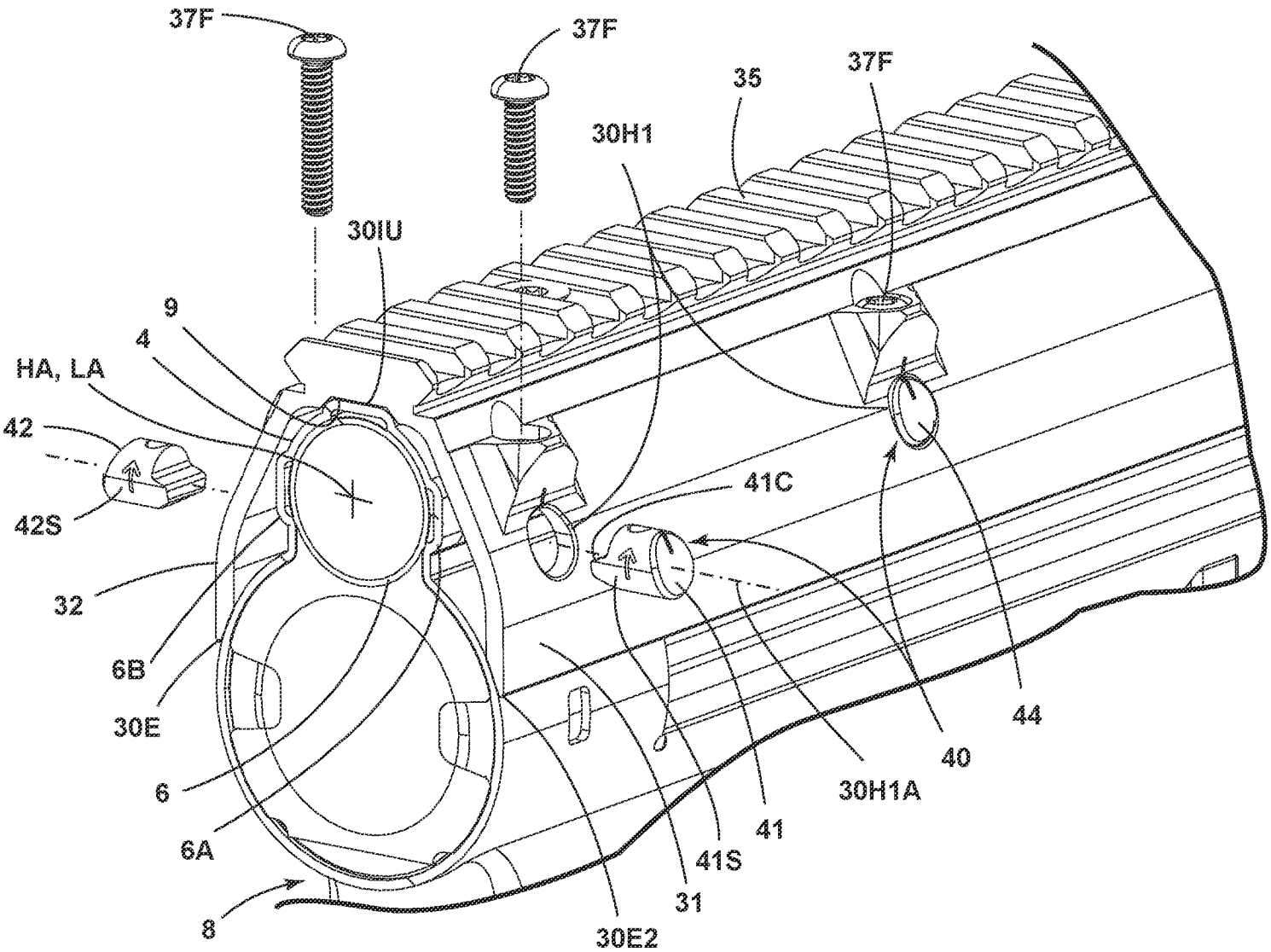
FIG. 5 is a close-up, section view of the firearm mount during assembly relative to the receiver.

In particular, with reference to FIG. 2, the single piece guard including the receiver shroud 30 and integral upper handguard 20 can be disposed over the upper surface or portion 9 of the receiver 6 and/or cocking lever housing 4. The shroud and upper handguard can be placed between a front site 8F and a rear sight 8R of the firearm 8 fitting within that span. The guard can be lowered until the respective receiver lower edges 30E and 30E2 engage the surface contours of the receiver 6 as shown in FIG. 5. There, the ramped surfaces can engage the respective contours of the receiver, and optionally, the interior surface 301 of the receiver shroud can engage at least a portion of the upper surface or portion 9. If there are any alignment blocks 9B (FIG. 4) on the receiver or upper surface 9, those can fit in corresponding recesses defined by the receiver shroud interior surface 301. The port ejection recess 36 when included also can be aligned with the ejection port 6P of the receiver 6.

With the receiver shroud 30 placed adjacent the receiver 6, the plugs 40 can be installed. As shown in FIGS. 5 and 6, the exemplary first and second plugs 41, 42 can be projected toward the respective first and second plug holes 30H1 and 30H2 of the respective first 31 and second 32 lateral side walls. The plugs can be moved or slid inward from the lateral side walls toward the longitudinal axis LA or the plane P3. The engagement surfaces 41S and 42S of the respective first and second plugs can engage the interior surfaces of the respective holes 30H1 and 30H2. Where the engagement surfaces optionally are cylindrical, the holes likewise can be cylindrical so that the respective plugs can move or slide inwardly toward the longitudinal axis LA and the plane P3. The first and second plugs can continue to slide toward one another and toward the receiver along the axis plug hole axis 30HA until the respective claws 41C and 42C are disposed adjacent and/or engage the respective ledges 6A and 6B of the receiver.

Upon this engagement, the fasteners 37F can be positioned in the respective holes 37AH and 37BH of the shoulders, and threaded into the respective first fastener hole 41H and the second fastener hole 42H of the plugs 41 and 42 respectively. As an example, shown in FIG. 7, the fastener 37F can be rotated in direction R about the fastener axis FA. As a result, the fastener threads into the first fastener hole 41H. This insertion of the plugs in the respective holes can be done for the remaining plugs to install them. The respective fasteners can be tightened as well. As a result, the claws can exert forces F1 on the respective ledges of the receiver. A corresponding force F2 is exerted by the receiver shroud interior surface 301 on the surface or other portion 9 of the receiver. As a result, the portion of the receiver, generally between the ledges and the upper surfaces of the receiver, are clamped between these components. With this clamping force, the receiver shroud and the upper handguard are secured to the receiver and thus the firearm in a clamp mode.

Optionally, after the mount 10 is secured to the firearm 8 in the clamp mode, a cocking lever 4C can be installed relative to the cocking lever housing 4. The cocking lever can be disposed at least partially through the slot 23. A user can cycle the cocking lever 4C to ensure that it sufficiently moves within the slot 23, for example in the first portion 21 and the second portion 22, along the respective paths of these slot portions.

Where included, the lower handguard 50 can be installed. As shown in FIG. 2, the lower handguard 50 can be positioned below the barrel and or the cocking lever housing. The lower handguard 50 can be moved upward toward the upper handguard 20. The respective holes 26A-26D of the upper handguard 20 can be aligned with the respective blocks 56A-56D. Corresponding lower handguard fasteners 59A-59 can be disposed or extended through the respective fastener holes of the upper handguard and into the respective connecting blocks. The fasteners can be sufficiently tightened to secure that lower handguard 50 to the upper handguard 20.

After the firearm mount 10 is installed on the firearm, accessories, such as reflex sights, red dots, scopes or other sights, lights or pressure switches can be installed on the mounting rail 35 as well as any other accessory mounting locations on the shroud 30, the upper handguard 20 and/or the lower handguard 50. To remove the firearm mount 10, the above procedure can be reversed.

Although the different elements and assemblies of the embodiments are described herein as having certain functional characteristics, each element and/or its relation to other elements can be depicted or oriented in a variety of different aesthetic configurations, which support the ornamental and aesthetic aspects of the same. Simply because an apparatus, element or assembly of one or more of elements is described herein as having a function does not mean its orientation, layout or configuration is not purely aesthetic and ornamental in nature.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. A method of using a firearm mount, the method comprising:

providing a firearm including a cocking lever housing joined with a receiver and an upper surface;

providing a receiver shroud integrally formed with an upper handguard to form a single piece guard, the receiver shroud including an uppermost portion having a mounting rail, a receiver shroud interior surface opposite the mounting rail, a first lateral sidewall on a first side of a longitudinal axis of the single piece guard extending downward from the mounting rail, and a second lateral sidewall on a second side of the longitudinal axis of the single piece guard extending downward from the mounting rail opposite the first lateral sidewall;

placing the single piece guard over the upper surface so that the receiver shroud simultaneously extends above the receiver as the upper handguard extends above the cocking lever housing of the firearm, the receiver shroud interior surface being disposed adjacent the upper surface of the firearm;

securing the single piece guard to the firearm in a fixed orientation;

sliding a first plug into a first plug hole defined by the first lateral sidewall toward the longitudinal axis of the single piece guard to engage a first ledge of the receiver;

installing a first fastener relative to the first plug;

sliding a second plug into a second plug hole defined by the second lateral sidewall toward the longitudinal axis of the single piece guard, in a direction opposite the first plug, to engage a second ledge of the receiver opposite the first ledge of the receiver; and installing a second fastener relative to the second plug.

2. A method of using a firearm mount, the method comprising:

providing a firearm including a cocking lever housing joined with a receiver and an upper surface;

providing a receiver shroud integrally formed with an upper handguard to form a single piece guard, the receiver shroud including an uppermost portion having a mounting rail, a receiver shroud interior surface opposite the mounting rail, a first lateral sidewall on a first side of a longitudinal axis of the single piece guard extending downward from the mounting rail, and a second lateral sidewall on a second side of the longitudinal axis of the single piece guard extending downward from the mounting rail opposite the first lateral sidewall;

placing the single piece guard over the upper surface so that the receiver shroud simultaneously extends above the receiver as the upper handguard extends above the cocking lever housing of the firearm, the receiver shroud interior surface being disposed adjacent the upper surface of the firearm;

securing the single piece guard to the firearm in a fixed orientation;

positioning a lower handguard below the cocking lever housing of the firearm; and extending a lower handguard fastener through a lower handguard fastener hole defined by the upper handguard to secure the lower handguard to the upper handguard.

3. The method of claim 1 comprising:

placing a cocking lever of the firearm in an L shaped slot defined by the single piece guard.

4. The method of claim 3 comprising:

moving the cocking lever in a first direction parallel to a barrel of the firearm; and moving the cocking lever in a second direction transvers to the first direction, wherein the cocking lever remains in the L shaped slot in the first direction and in the second direction.

5. A method of using a firearm mount, the method comprising:

providing a firearm including a cocking lever housing joined with a receiver and an upper surface;

providing a receiver shroud integrally formed with an upper handguard to form a single piece guard, the receiver shroud including an uppermost portion having a mounting rail, a receiver shroud interior surface opposite the mounting rail, a first lateral sidewall on a first side of a longitudinal axis of the single piece guard extending downward from the mounting rail, and a second lateral sidewall on a second side of the longitudinal axis of the single piece guard extending downward from the mounting rail opposite the first lateral sidewall;

placing the single piece guard over the upper surface so that the receiver shroud simultaneously extends above the receiver as the upper handguard extends above the cocking lever housing of the firearm, the receiver shroud interior surface being disposed adjacent the upper surface of the firearm;

securing the single piece guard to the firearm in a fixed orientation;

installing a plug in a plug hole defined by the first lateral sidewall and extending toward the longitudinal axis of the single piece guard; and engaging a claw of the plug against a ledge of the receiver.

6. The method of claim 5 comprising:

engaging a fastener transversely oriented relative to the plug hole to secure the single piece guard to the receiver.

7. A method of using a firearm mount, the method comprising:

providing a firearm including a cocking lever housing joined with a receiver and an upper surface;

providing a receiver shroud integrally formed with an upper handguard to form a single piece guard, the receiver shroud including an uppermost portion having a mounting rail, a receiver shroud interior surface opposite the mounting rail, a first lateral sidewall on a first side of a longitudinal axis of the single piece guard extending downward from the mounting rail, and a second lateral sidewall on a second side of the longitudinal axis of the single piece guard extending downward from the mounting rail opposite the first lateral sidewall;

placing the single piece guard over the upper surface so that the receiver shroud simultaneously extends above the receiver as the upper handguard extends above the cocking lever housing of the firearm, the receiver shroud interior surface being disposed adjacent the upper surface of the firearm;

securing the single piece guard to the firearm in a fixed orientation; and rotating a fastener to engage a plug against a ledge of the receiver.

8. The method of claim 7 comprising:

placing a cocking lever of the firearm in an L shaped slot defined by the single piece guard.

9. A method of using a firearm mount, the method comprising:

providing a firearm including a cocking lever housing joined with a receiver and an upper surface;

providing a receiver shroud integrally formed with an upper handguard to form a single piece guard, the receiver shroud including an uppermost portion having a mounting rail, a receiver shroud interior surface opposite the mounting rail, a first lateral sidewall on a first side of a longitudinal axis of the single piece guard extending downward from the mounting rail, and a second lateral sidewall on a second side of the longitudinal axis of the single piece guard extending downward from the mounting rail opposite the first lateral sidewall;

placing the single piece guard over the upper surface so that the receiver shroud simultaneously extends above the receiver as the upper handguard extends above the cocking lever housing of the firearm, the receiver shroud interior surface being disposed adjacent the upper surface of the firearm;

securing the single piece guard to the firearm in a fixed orientation; and placing a cocking lever slot of the upper handguard on an opposite side of the firearm from an ejection port recess of the receiver shroud.

10. A method of using a firearm mount, the method comprising:

providing a firearm including a cocking lever housing joined with a receiver and an upper surface, the cocking lever housing configured to allow movement of a cocking lever along an L-shaped path;

providing a receiver shroud integrally formed with an upper handguard to form a single piece guard, the receiver shroud including an uppermost portion having a mounting rail;

placing the single piece guard over the upper surface so that the receiver shroud simultaneously extends above the receiver as the upper handguard extends above the cocking lever housing of the firearm;

securing the single piece guard to the firearm in a fixed orientation; and rotating a fastener to engage a plug against a ledge of the receiver.

11. The method of claim 10 comprising:

placing the cocking lever of the firearm in an L shaped slot defined by the single piece guard so that the cocking lever can move along the L shaped path while the cocking lever housing is covered by the upper handguard.

12. The method of claim 10 comprising:

installing a receiver shroud interior surface opposite the mounting rail so that the receiver shroud interior surface faces the uppermost surface, and so that a first lateral sidewall on a first side of a longitudinal axis of the single piece guard extends downward from the mounting rail, and a second lateral sidewall on a second side of the longitudinal axis of the single piece guard extends downward from the mounting rail opposite the first lateral sidewall.

13. A method of using a firearm mount, the method comprising:

providing a firearm including a cocking lever housing joined with a receiver and an upper surface, the cocking lever housing configured to allow movement of a cocking lever along an L-shaped path;

providing a receiver shroud integrally formed with an upper handguard to form a single piece guard, the receiver shroud including an uppermost portion having a mounting rail;

placing the single piece guard over the upper surface so that the receiver shroud simultaneously extends above the receiver as the upper handguard extends above the cocking lever housing of the firearm;

securing the single piece guard to the firearm in a fixed orientation; and installing a plug in a plug hole defined by the receiver shroud and extending toward a longitudinal axis of the single piece guard; and engaging a claw of the plug against a ledge of the receiver.

14. The method of claim 13 comprising:

engaging a fastener transversely oriented relative to the plug hole to secure the single piece guard to the receiver.

15. A method of using a firearm mount, the method comprising:

providing a firearm including a cocking lever housing joined with a receiver and an upper surface, the cocking lever housing configured to allow movement of a cocking lever along an L-shaped path;

providing a receiver shroud integrally formed with an upper handguard to form a single piece guard, the receiver shroud including an uppermost portion having a mounting rail;

placing the single piece guard over the upper surface so that the receiver shroud simultaneously extends above the receiver as the upper handguard extends above the cocking lever housing of the firearm;

securing the single piece guard to the firearm in a fixed orientation;

positioning a lower handguard below the cocking lever housing of the firearm; and extending a lower handguard fastener through a lower handguard fastener hole defined by the upper handguard to secure the lower handguard to the upper handguard.

16. A method of using a firearm mount, the method comprising:

providing a firearm including a cocking lever housing joined with a receiver and an upper surface;

placing a single piece guard, including a receiver shroud integrally formed with an upper handguard, over the upper surface so that the receiver shroud simultaneously extends above the receiver as the upper handguard extends above the cocking lever housing of the firearm; and securing the single piece guard to the firearm in a fixed orientation by rotating a fastener to engage a plug against a ledge of the receiver.

17. The method of claim 16 comprising:

placing a cocking lever of the firearm in an L shaped slot defined by the single piece guard forward of the receiver.

* * * * *